US005988188A

United States Patent [19]

Born

[11] Patent Number: 5,988,188

[45] Date of Patent: Nov. 23, 1999

[54] METHOD AND APPARATUS TO REMOVE OBSTRUCTIONS FROM SEWERS WITHOUT CUTTERS OR CHEMICALS

[75] Inventor: Joseph C. Born, Burlington, Iowa

[73] Assignee: JIR, Inc., Burlington, Iowa

[21] Appl. No.: 09/001,482

[22] Filed: Dec. 31, 1997

Related U.S. Application Data

[60] Provisional application No. 60/033,799, Dec. 31, 1996.

[51] Int. Cl.[6] ..... B08B 9/02

[52] U.S. Cl. ..... 134/22.11; 134/22.12

[58] Field of Search ..... 134/22.11, 22.12, 134/24, 31, 23, 30, 22.15

[56] References Cited

U.S. PATENT DOCUMENTS

| | | | |
|---|---|---|---|
| 77,857 | 5/1868 | Young | 138/35 |
| 2,117,648 | 5/1938 | Bottorf | 134/24 |
| 2,694,022 | 11/1954 | Schreiner | 134/24 |
| 2,735,794 | 2/1956 | Pletcher | 134/24 |
| 2,758,917 | 8/1956 | Popp | 134/24 |
| 2,763,288 | 9/1956 | Tharp | 137/565.12 |
| 3,171,150 | 3/1965 | Gray | 15/104.12 |
| 3,525,112 | 8/1970 | Masters | 15/104.12 |
| 3,535,161 | 10/1970 | Gutrich | 134/24 |
| 3,600,225 | 8/1971 | Parmelee | 134/24 |
| 3,658,589 | 4/1972 | Shaddock | 134/24 |
| 4,082,567 | 4/1978 | Conklin et al. | 134/10 |
| 5,551,458 | 9/1996 | Faxon | 134/24 |

*Primary Examiner*—Saeed Chaudhry
*Attorney, Agent, or Firm*—Keith Frantz

[57] ABSTRACT

Adapter fittings formed with an opening therethrough are inserted into a sewer manhole with the outlet opening facing an obstruction, or build-up along the sewer walls. A forwardly thrusting nozzle adapted to spray jets of high-pressure, high-temperature water or steam is connected to a hose. Alternately, a nozzle adapted to spray jets of high-pressure, high-temperature water of steam forwardly therefrom is connected to a hose and a stiffened push wand. The nozzle and hose and/or push wand are then inserted through the adapter fittings to exit from the outlet opening into the leg of the sewer with the build-up or obstruction. A hot water/steam supply connected to the upstream end of the hose provides a supply of steam or hot, pressurized water to the nozzle. The nozzle is advanced through the sewer line to remove the build-up from the sewer walls with the aid of the hot, pressurized jets of water, and/or to an obstruction whereupon the obstruction is cleared with one of several alternate methods utilizing the hot, pressurized water or steam.

18 Claims, 7 Drawing Sheets

FIG. 4A
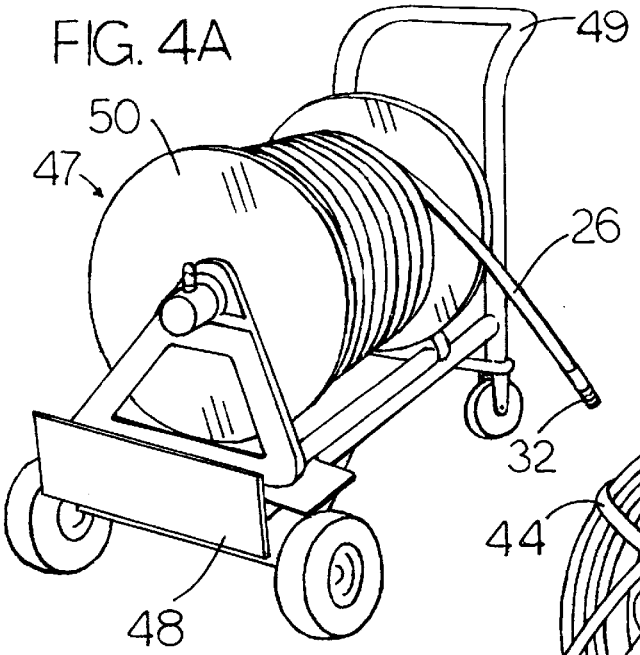
FIG.4B
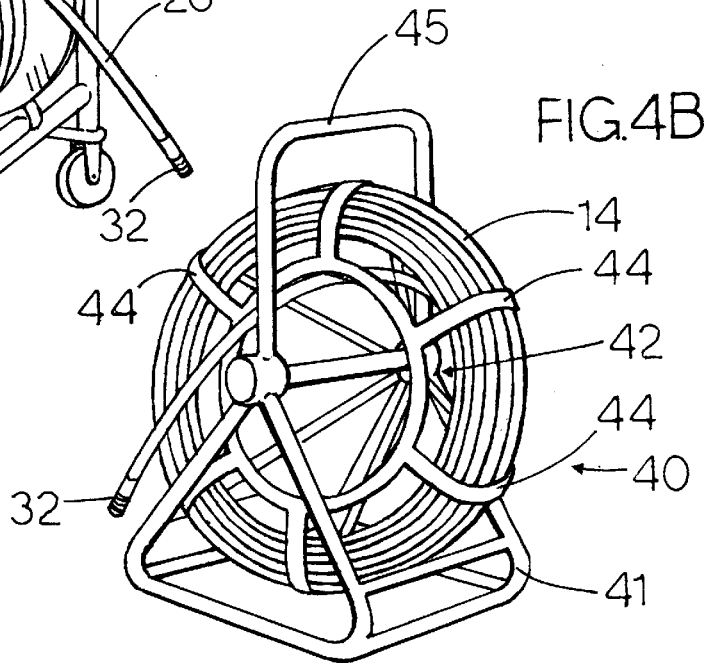
FIG.3
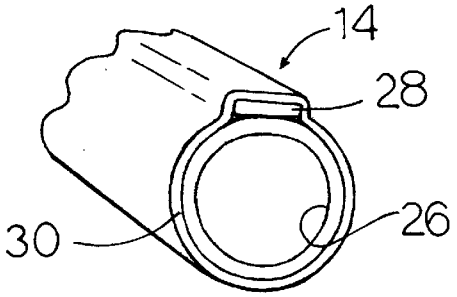
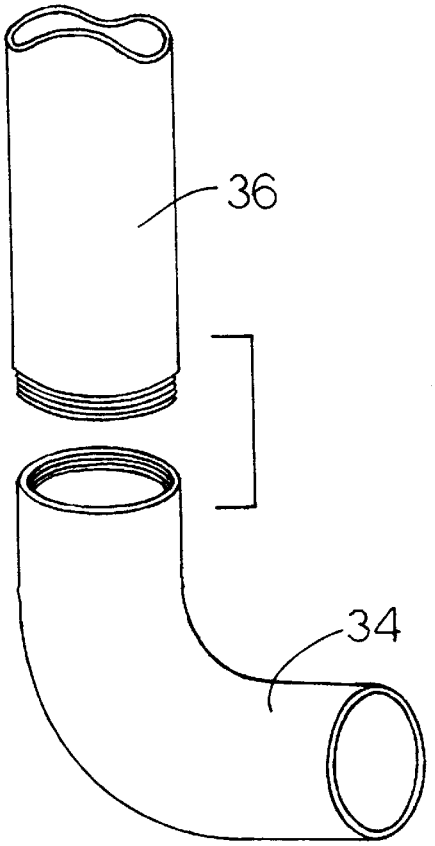
FIG. 5

FIG. 6
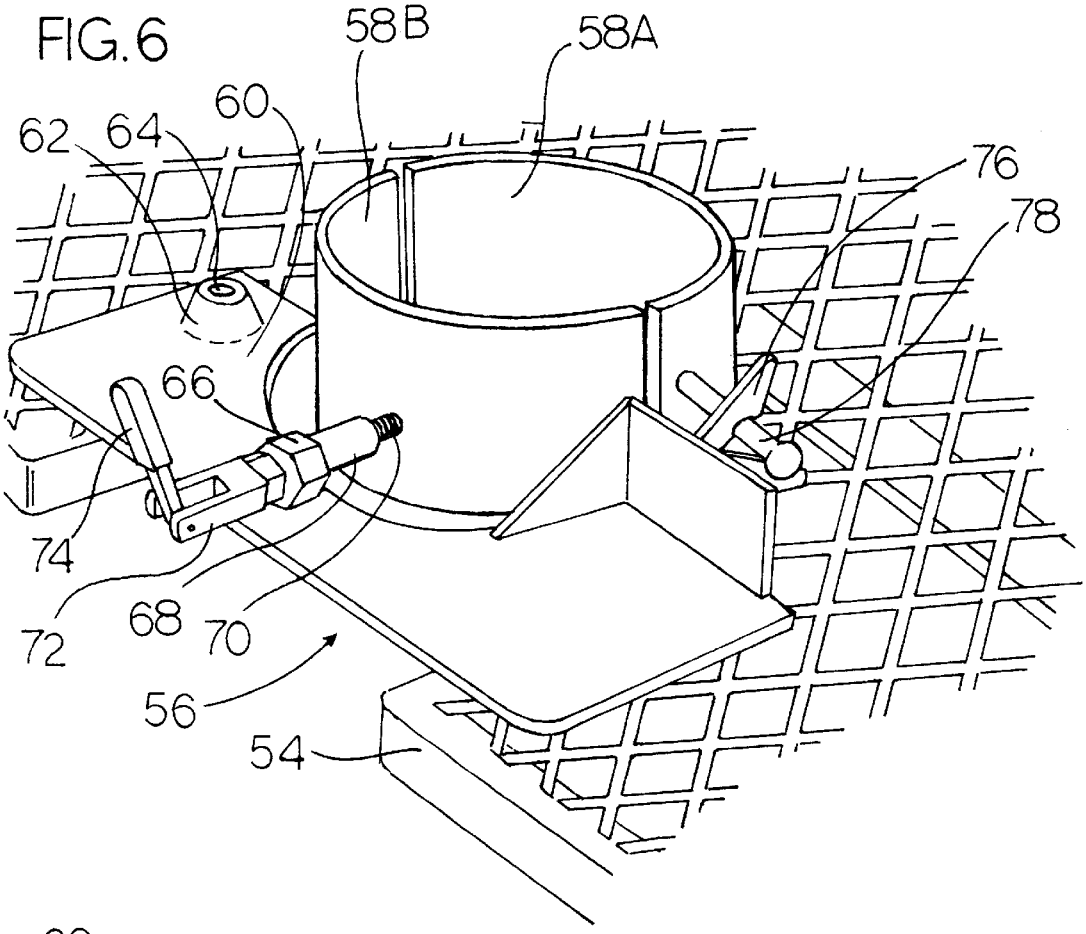
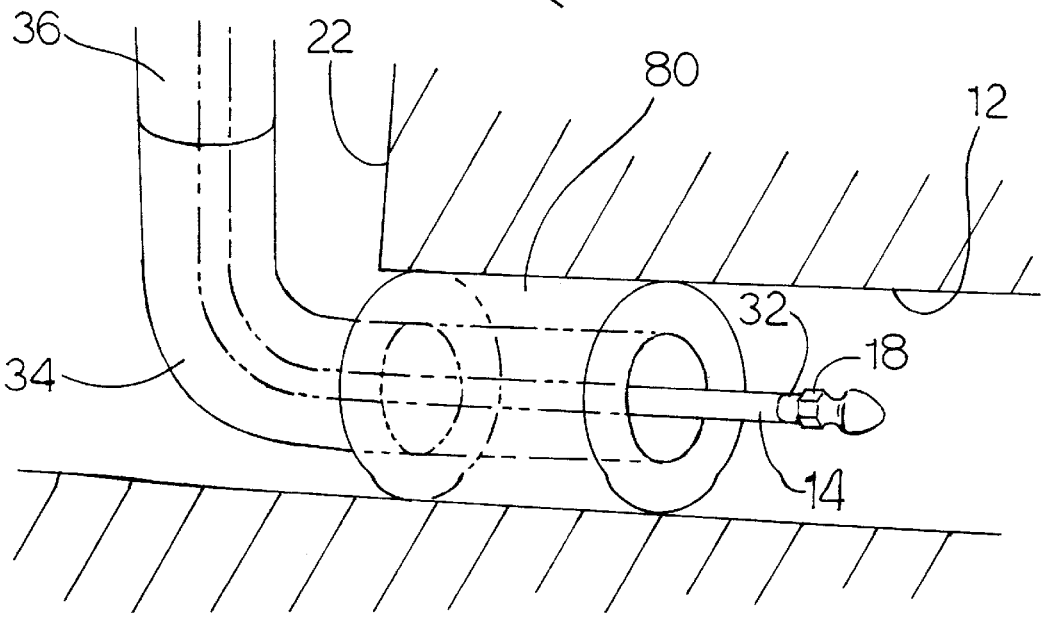
FIG. 7

FIG. 8
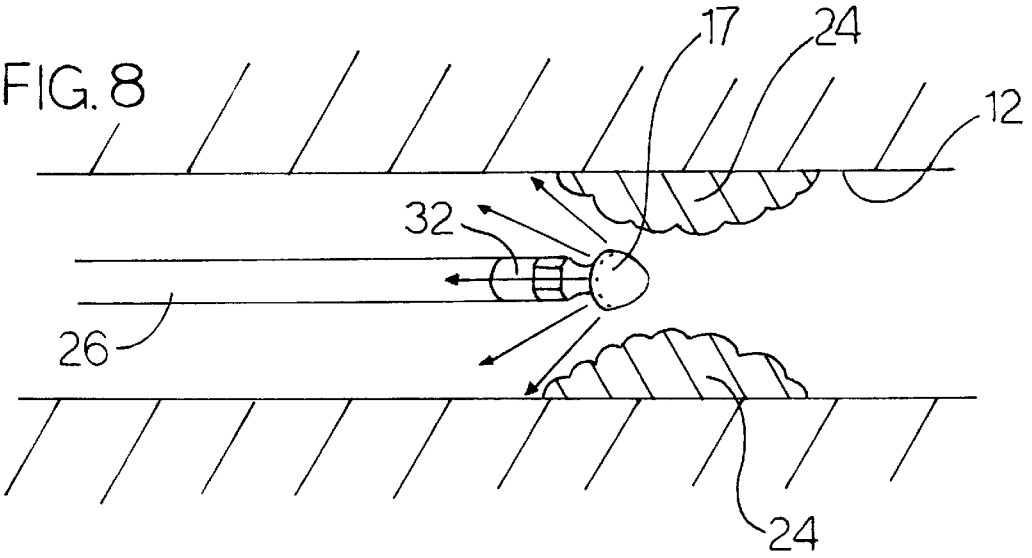
FIG. 9A
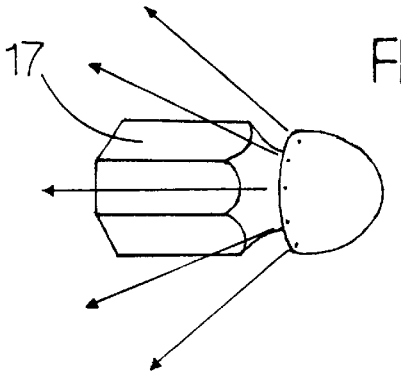
FIG. 9B
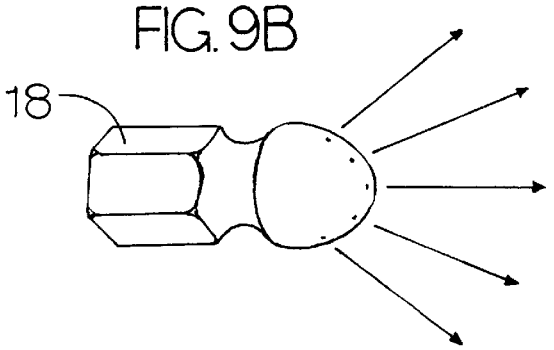
FIG. 9C
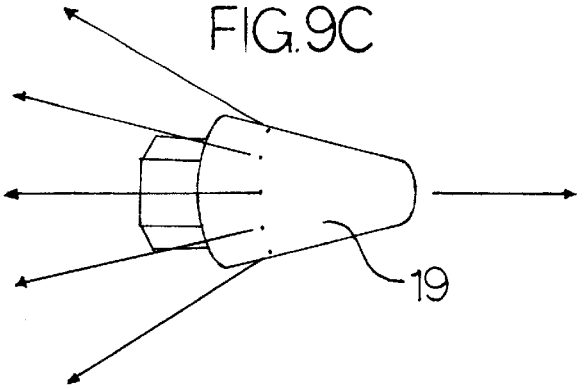
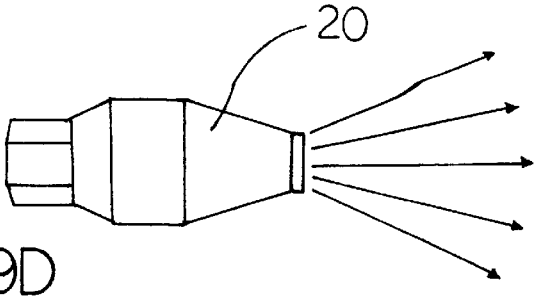
FIG. 9D FIG. 12
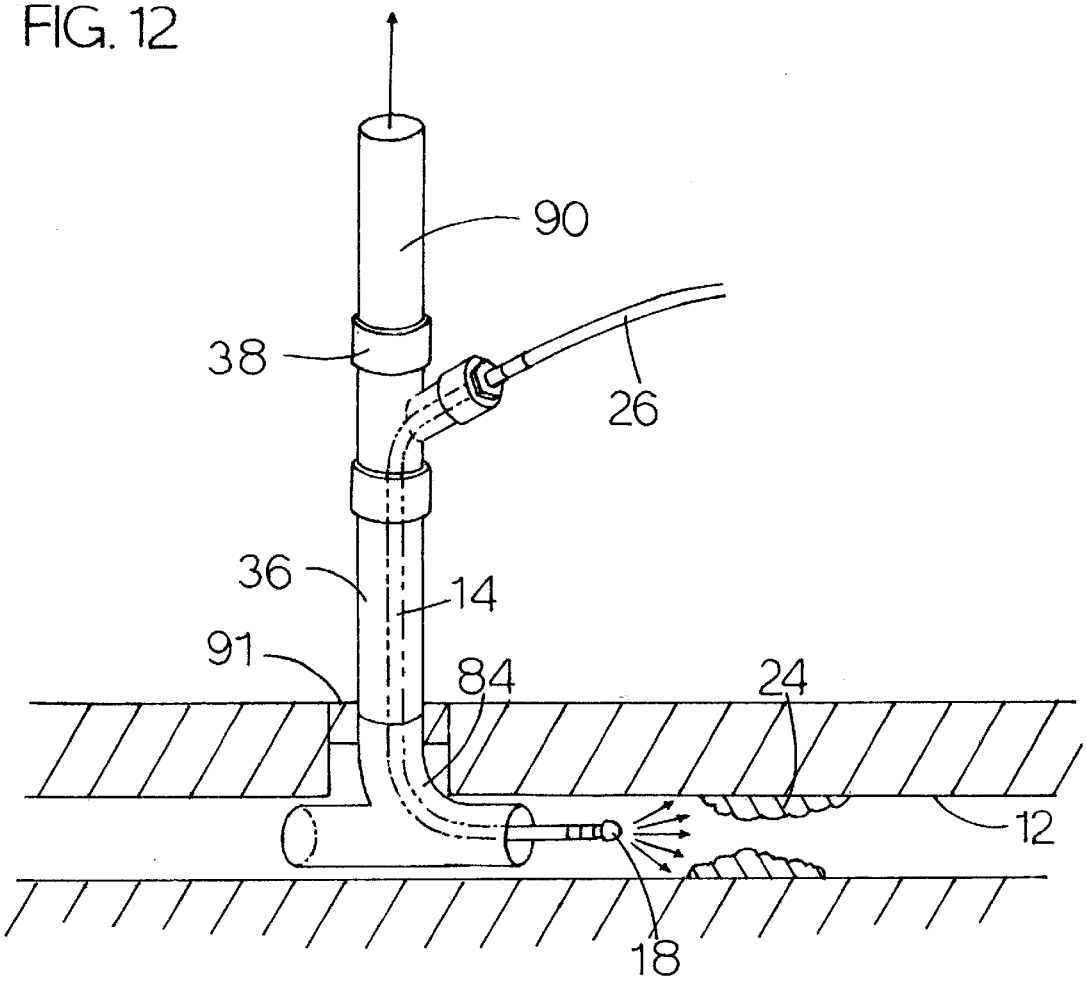
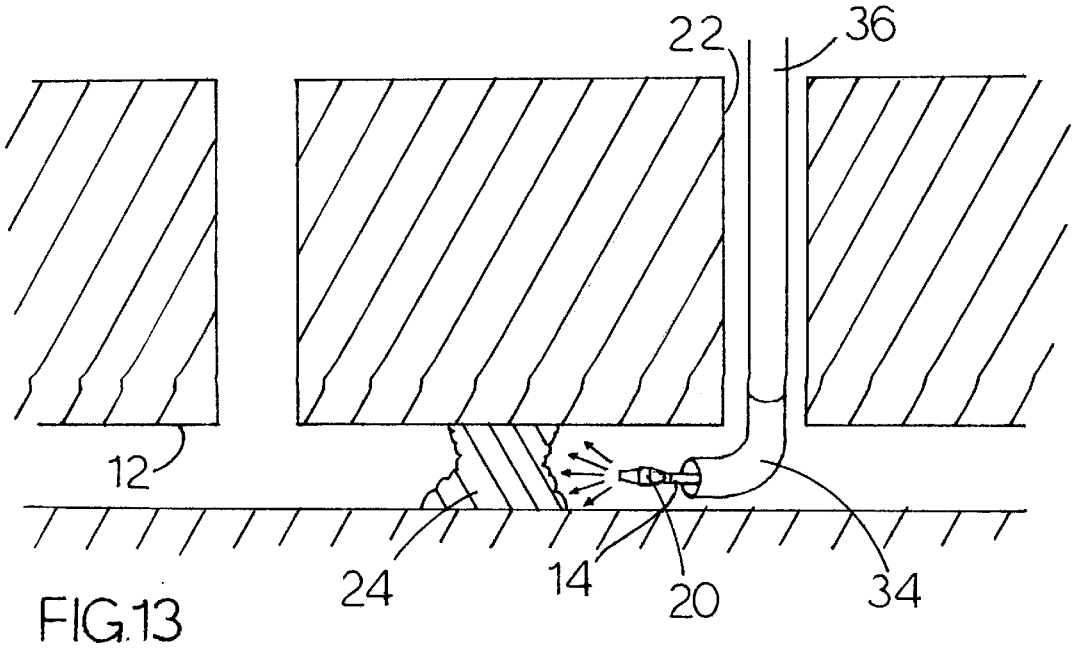
FIG.13

METHOD AND APPARATUS TO REMOVE OBSTRUCTIONS FROM SEWERS WITHOUT CUTTERS OR CHEMICALS

This application claims benefit of Provisional application CFR No. 60/033,799 filed Dec. 31, 1996.

BACKGROUND OF THE INVENTION

The present invention relates generally to apparatus and methods for removing obstructions from sewers, and more specifically, to apparatus and methods for the removal of obstructions without the need for chemicals or cutters.

Prior methods for removing build-up or obstructions from sewer pipes and drain lines include the use of chemicals, mechanical cutters, and so-called "jetter" nozzles.

A jetter nozzle is connected to a hose and a cold water supply, and advances forwardly in a sewer line by spraying jets of water rearwardly and radially outwardly at an angle from horizontal. A jetter nozzle typically provides for a single forwardly directed stream of cold water, however, the bulk of the cleaning action is limited to along the walls of the sewer line rearwardly of the nozzle, such cleaning resulting from the rearwardly directed streams of water impinging the sewer wall. Although the forwardly directed stream is capable of eroding a hole through certain materials, such nozzles have difficulty advancing through a substantially or completely blocked sewer line since the cleaning action occurs behind the nozzle. Thus, jetter nozzles are typically limited to removing build-up that is relatively soft such as grease or organic waste, and have difficulty advancing through a blocked or substantially obstructed sewer line.

Mechanical cutters are capable of opening large or relative solid obstructions in sewer lines, however, such cutter arrangements tend to be relatively expensive, and to avoid damage to the walls of sewer pipe, mechanical cutters are typically used to open a blockage, not to completely clear the obstruction from the sewer line. Using mechanical cutters to opening a sewer line also tends to be a relatively slow operation.

The use of chemicals is typically limited to those instances where the sewer line is completely blocked since the chemicals will simply flow past the obstruction when an opening is created. It is possible to block a sewer line downstream of an obstruction with, for example, an inflatable plug commonly known as a cherne plug, thus preventing the loss of the chemicals when an opening is created through the obstruction. However, and particularly when dealing with relatively large diameter sewer lines, and considering the distance often encountered between the location of an upstream and a downstream manhole, the volume of chemicals needed to "fill" the closed portion of the line make such a solution relatively expensive and generally impractical. Moreover, it will typically be difficult to determine the time required for the chemicals to sufficiently dissolve the obstruction so as to eliminate the concern that the resulting waste will not become lodged downstream.

Thus, it is desirable to provide for new and improved apparatus and methods for cleaning build-up from sewer lines, for opening blocked sewer lines without the need to use chemicals or mechanical cutters, and for completely clearing the lines of both hard and soft matter such as grease, tree root structure, soap, and organic waste.

SUMMARY OF THE INVENTION

The general aim of the present invention is to provide new and improved apparatus and methods for cleaning sewer and drain lines, and opening and removing build-up and obstructions from such lines, with out the need to use chemicals or mechanical cutters.

A detailed objective is to achieve the foregoing by providing nozzles adapted to direct jets of high-pressure, high-temperature water or steam toward the build-up or obstruction, and to provide means for guiding such nozzles into the sewer line.

Another objective of the invention is to provide means for advancing power jet nozzles in the sewer line, such nozzles being adapted to direct jets of high-pressure, high-temperature water and/or steam in a forwardly direction for removal of obstructions in the sewer line forwardly of the nozzle.

A more detailed objective is to provide unique push wand means and adapter fittings to guide the nozzle into the sewer line and to counter-act the rearwardly directed thrust forces of the forwardly cleaning power jet nozzles so as to enable use thereof in a sewer line.

The invention also resides in unique methods of cleaning sewer and drain lines with the above-mentioned apparatus, including the conventional rearwardly cleaning, forwardly thrusting nozzles adapted for use with high-pressure, high-temperature water and steam.

These and other objectives and advantages of the invention will become more apparent from the following detailed description when taken in conjunction with the accompanying drawings.

In general, the apparatus according to the invention includes the use of nozzle jets adapted to discharge jets of high-pressure, high-temperature water or steam, supply means to provide the high-pressure, high-temperature water and steam, and hose means connected between the selected nozzle and the water/steam supply.

Both forwardly and rearwardly discharging nozzles are utilized, and combinations thereof. Generally rearwardly discharging nozzles are specially adapted for use with the high-pressure and high-temperature supply in accordance with the invention. When a forwardly discharging nozzle is selected for use in cleaning the sewer line, a stiffened push wand is connected to the nozzle or downstream portion of the supply hose to assist in overcoming the rearwardly thrusting forces of such nozzles and enable manually maintaining the nozzle in position in the drain line or advancing such nozzles through the drain line.

Adapter fittings are provided for use when cleaning underground sewer lines. The adapter fittings are generally hollow pipe-type fittings that are inserted into a manhole to provide controlled and guiding access to the sewer line. Specifically, the fittings include an above-ground opening for receiving the nozzle and supply hose, and a lower opening that faces into the sewer line toward the build-up or obstruction such that the nozzle is automatically guided toward the obstruction by simply feeding downwardly through the adapter fittings. A supporting apparatus is also provided to stabilize the adapter fittings when positioned in the manhole and sewer line.

Advantageously, the adapter fittings provide supporting back wall structure for the push wand when using a forwardly discharging nozzle in a sewer line. Such an arrangement uniquely enables use of primarily forwardly discharging nozzles, as well and rearwardly discharging nozzles, for cleaning sewer and drain lines.

An inflatable plug is utilized in certain instances to control flow through the sewer line, and to prevent flow for creating a contained environment in which the temperature can be raised for softening of obstructing materials. And a wash-down station is optionally provided at the upper end of the adapter fittings.

The invention also contemplates numerous methods for cleaning drain and sewer lines utilizing the above-mentioned apparatus, and depending on the nature and location of the obstruction.

The inventive apparatus and methods as herein described may be adapted and utilized in a wide variety of sanitary sewer systems, but, for reasons which will become apparent, are particularly useful in sewers and drain lines of between about two (2) inches to two (2) feet diameter.

BRIEF DESCRIPTION OF THE DRAWINGS

FIG. 3 is view similar to FIG. 2 but showing the sleeve snugly positioned surrounding the stiffener and hose.

FIGS. 4A and 4B are perspective views of mobile reels for holding a high pressure hose and a push wand, respectively.

FIG. 5 is an enlarged perspective view of an invert down-leg extension and a 90 degree elbow down-leg invert adapter illustrated in FIG. 1.

FIG. 6 is an enlarged perspective view an invert down-leg hold-down bracket illustrated in FIG. 1.

FIG. 7 is an enlarged perspective view illustrating the placement of the push wand and a nozzle tip through the invert elbow adapter and an inflatable cherne plug.

FIG. 8 is an enlarged perspective view of a forwardly thrusting nozzle tip of FIG. 9A removing build-up from the side walls of a drain line.

FIGS. 9A–9D are enlarged perspective views of four nozzle tips suitable for use in the present invention.

FIGS. 11 and 12 are perspective views of alternate permanent installations in accordance with the invention.

FIG. 13 is a view similar to FIG. 10 but showing an alternate arrangement of the present invention.

Figure 1:
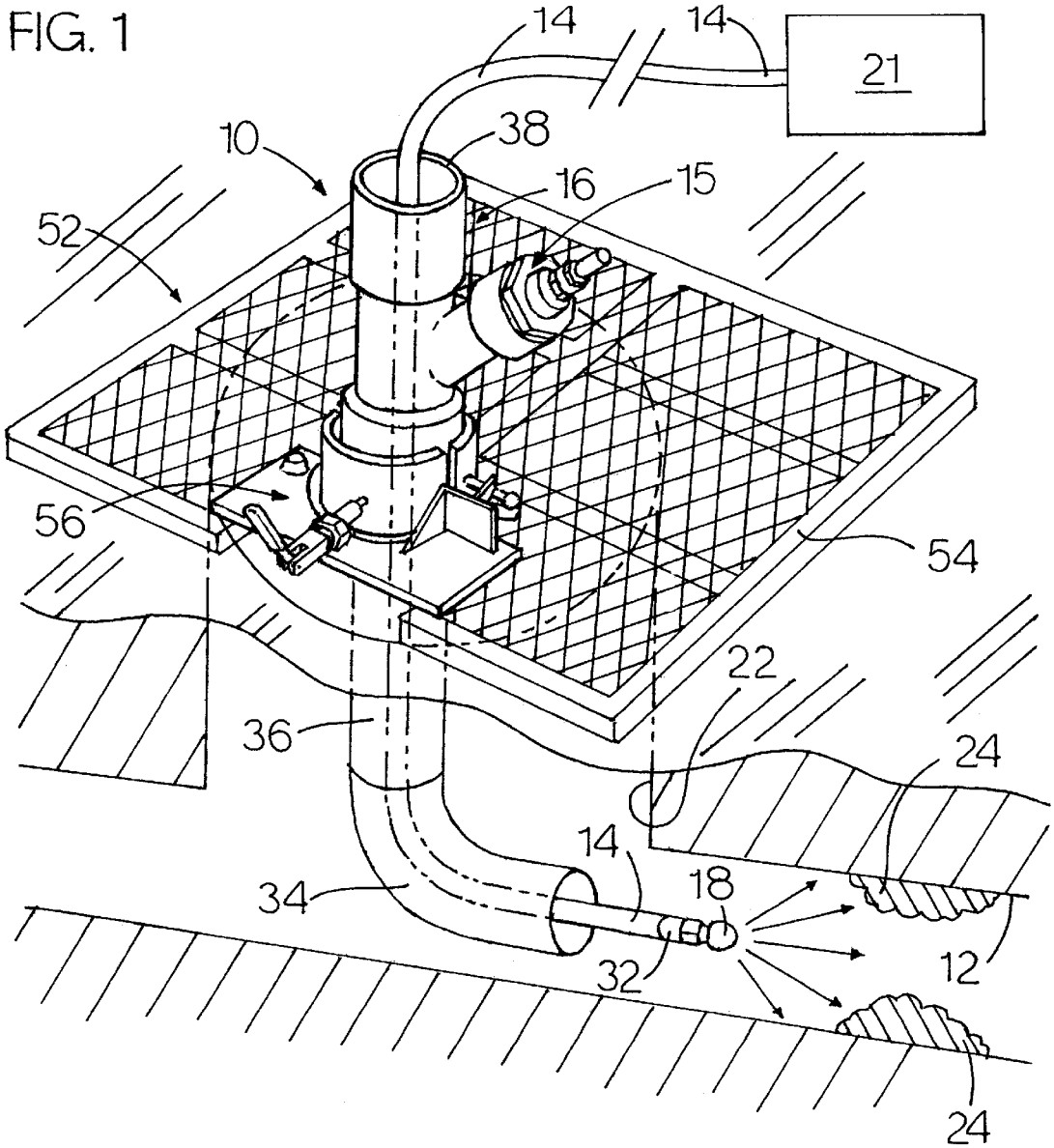
FIG. 1 is a perspective view of an apparatus for cleaning obstructions from a sewer line and showing the unique aspects of the present invention.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

This application claims the benefit of U.S. Provisional Application No. 60/033,799, filed Dec. 31, 1996.

For purposes of illustration, one embodiment of the invention is shown in the drawings as apparatus 10 (FIG. 1) adapted to clean out an underground sewer line 12.

In general, the apparatus 10 includes a nozzle adapted to discharge directed jets or streams of high-pressure, high-temperature water or steam through orifices formed therein for clearing and cleaning the sewer line, a combination hot water and steam supply 21 for providing a supply of steam or water at predetermined or selected pressures and temperatures, fluid transport means such as hose 26 connected between the nozzle and the supply 21 for transfer of the water or steam to the nozzle, and adapter fittings generally indicated in the drawings as 16, the adapter fittings (a) being sized to slip down into a sewer manhole 22, (b) having an opening extending therethrough and sized to slidably receive the nozzle and hose, and (c) adapted to guide the nozzle into the sewer line 12 in the direction toward a flow-restricting build-up or obstruction 24, and means for advancing the nozzle forwardly in the sewer line to enable the streams of water of steam discharging from the nozzle to clean the line as the nozzle approaches and/or passes through the obstruction.

Except as otherwise noted, the directions "upstream" and "downstream" refer herein to the normal direction of flow in a drain pipe or sewer line 12 resulting from the slope or grade of the line, and the directions "forward" (or forwardly) and "rearward" (or rearwardly) refer to the upstream and downstream directions, respectively, of the flow through the hose 26 and the nozzle. Further, except as indicated with an arrow in the drawings, it will be understood that the natural direction of flow through the sewer lines shown in the drawings may be in either direction with respect to the build-up or obstruction and the apparatus 10 shown therewith.

The hose 26 is typically a conventional high-pressure, high-temperature hose with connecting means such as threaded ends for releasably connecting to the supply 21 and a nozzle, the nozzle being connected to the downstream end of the hose. When not in use, the hose may be wound onto a spool 50 (FIG. 4A) carried on a mobile cart 47 equipped wheels for ease in transporting the hose 26 from place to place. The cart illustrated includes a frame 48 for rotatably supporting the spool and hose, and a handle to aid in relocation of the cart and the hose.

Hot water and steam may be provided with a conventional power jet steam supply 21. Such a supply is commonly capable of providing hot water at a pressure of up to 3000 psi, and steam up to 325 degrees Fahrenheit, and typically provides for variable settings to enable the adjustment of pressures and temperatures. Other water and/or steam supply sources may also be suitable for supplying water or steam to the nozzle. As further discussed below, the selection between water and steam, and the selection of the operating temperature and pressure, is based in part on factors such as the nozzle selected, the inside diameter of the pipe or sewer line, and the type of build-up or obstruction in the pipe or sewer line.

The nozzle 18 shown in FIG. 1 is a power jet nozzle adapted to direct streams of hot water or steam forwardly from the downstream tip of the nozzle in a generally conical-shaped spray pattern expanding radially outwardly from the tip of the nozzle. The direction of the jets issuing from the nozzle 18 results in a rearwardly directed thrust, tending to drive the nozzle away from the obstruction 24. Such a result has generally precluded the use of forwardly discharging, rearwardly thrusting nozzles in prior sewer cleaning arrangements.

Figure 2:
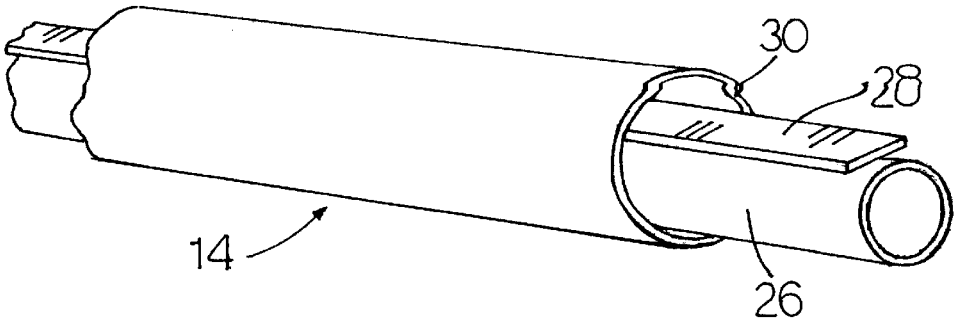
FIG. 2 is an enlarged fragmentary perspective view of a push wand illustrated in FIG. 1, but showing an outer sleeve in a relaxed position prior to shrinking onto a stiffener and hose located therein.
Figure 15:
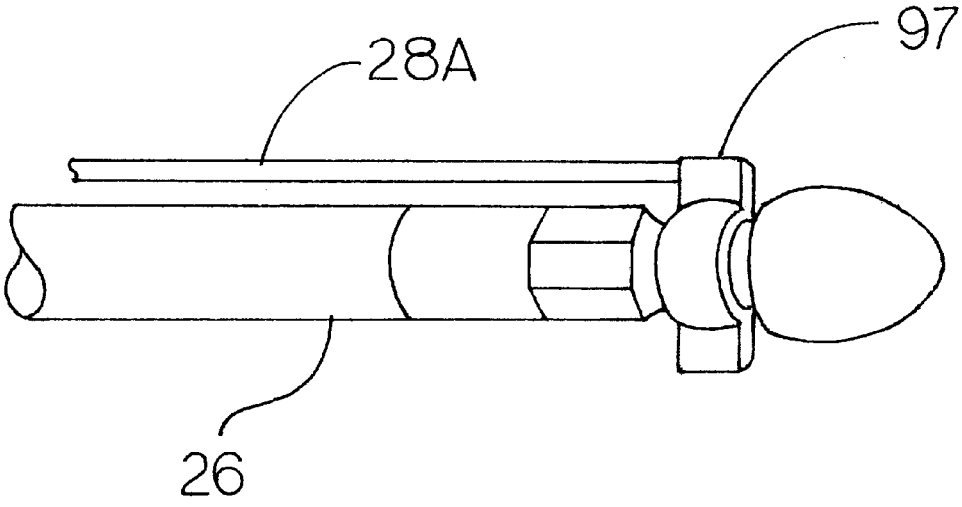
FIG. 15 is a view of alternate push wand arrangement with the push wand connected to the nozzle.

In keeping with the invention, a relatively stiff cable or push wand is connected to the power jet nozzle 18 such that the nozzle may be manually forced through the sewer line to the obstruction 24. The stiffened cable or member 28A (FIG. 15) may be either connected directly to the nozzle, to an adapter 97 which is in-turn connected to or integrally formed with the nozzle, or to at least the downstream end portion of the high-temperature hose 26. For purposes herein, except as otherwise noted, reference to the "push wand" will refer to the arrangement of the stiffened member secured to the hose 26 as discussed below and shown in detail in FIGS. 2 and 3, but it is understood that an arrangement with member 28A is interchangeable with push wand 14.

In this instance, the push wand 14 includes an elongated stiffener cable or member 28 made from, for example, metal or rigid plastic, extending along the length of the hose 26, and an outer sleeve 30 securing the stiffener 28 to the hose 26. The sleeve 30 shown is a heat-shrink sleeve that is slipped into place over the stiffener and the hose (see FIG. 2), and shrinks to snugly hold the hose and the stiffener together upon the application of heat, securing the stiffener to the hose (see FIG. 3). It will be apparent that the push wand of FIG. 3 may be manufactured in other ways such as, for example, by extruding an outer sleeve along the length of the hose and stiffener.

Due to the relatively "stiff" nature of the push wand 14, a rotatable cage structure 42 (FIG. 4B) is provided storage between uses, and for unwinding and winding the push wand as it is inserted into or removed from the sewer line. The cage structure is rotatably carried by a frame 41 of a unit 40 that is equipped with a handle 45 for carrying the push wand from place to place. The cage structure includes an inner hub, and bands 44 extending radially outwardly from and between each side of the hub to generally surround and confine the push wand as it is coiled therein.

In general, the adapter fittings 16 are inserted through an opening or manhole 22 providing access to the sewer, and are adapted to provide a guiding inlet into the sewer line, and toward the obstruction, for the nozzle 18 and the hose 26 or push wand 14. The adapter fittings shown in FIG. 1 include a so-called down-leg invert adapter in the form of a 90 degree elbow or sweep section 34, an invert down-leg extension 36 releasably connected to the adapter 34 such as with a threaded connection or other suitable means, and an end adapter 38 equipped with an optional wash down station 15 adapted to spray clean water on the hose or push wand as it is removed from the sewer line. The extension 36 is preferably sized or selected to extend above ground level with the sweep adapter 34 resting in the sewer line at the bottom of the manhole and with the outlet opening or the adapter facing toward the obstruction 24. With this arrangement, the nozzle and hose or push wand may be dropped down the extension 36 and partially through the elbow 34 which immediately directs the nozzle toward the obstruction. The nozzle may then be quickly and easily advanced through the sewer pipe until reaching the obstruction.

Advantageously, the back wall portion of the elbow 34 and the extension 36 aid in supporting the push wand when using a nozzle with a forwardly directional discharge and resulting rearwardly directed thrust forces, allowing the operator of the apparatus 10 to hold the nozzle in a desired position in the sewer line for clearing an obstruction, or manually force the nozzle forwardly through the sewer line.

As further discussed below, the adapter fittings installed into the sewer line may include an inflatable plug 80 to seal a portion of the sewer line, to provide for a contained environment surrounding an obstruction, and/or ensure a proper flow channel is established for any water or waste in the sewer line. With the exception of the inflatable plug 80, the adapter fittings are preferably formed from relatively stiff, lightweight material such as modified conventional PVC pipe sections.

Figure 11:
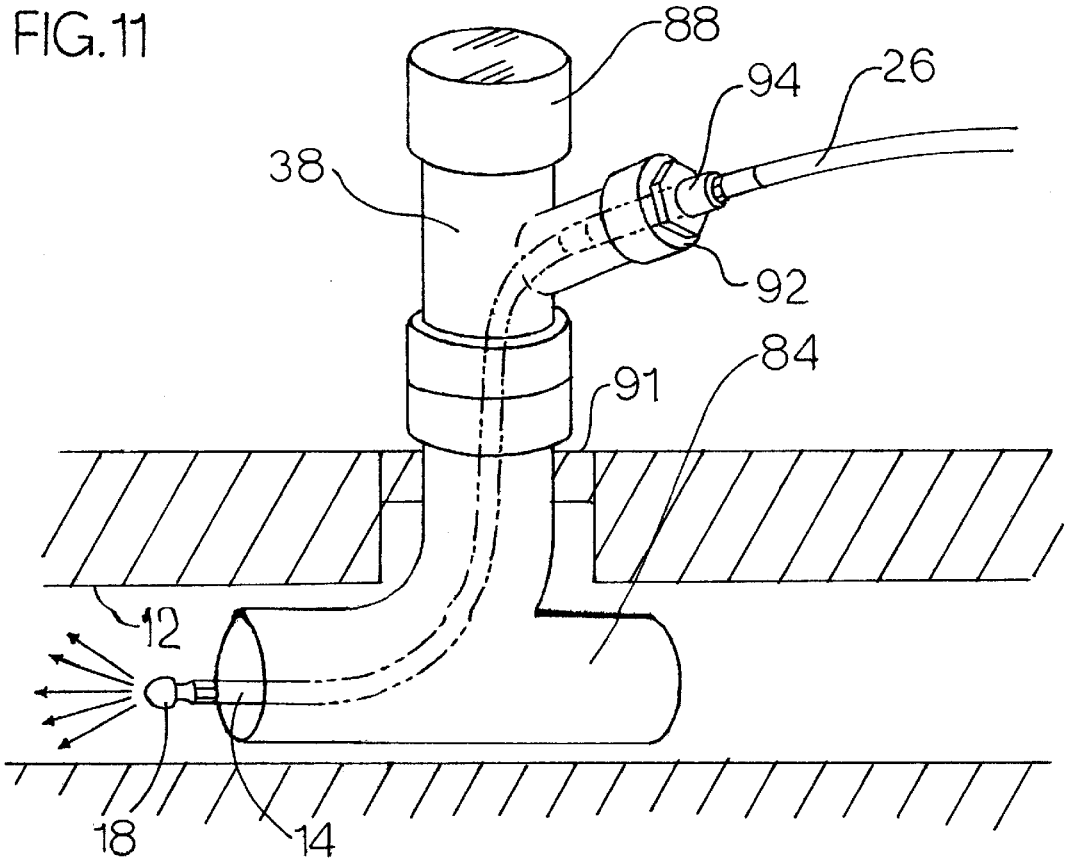
Figure 14:
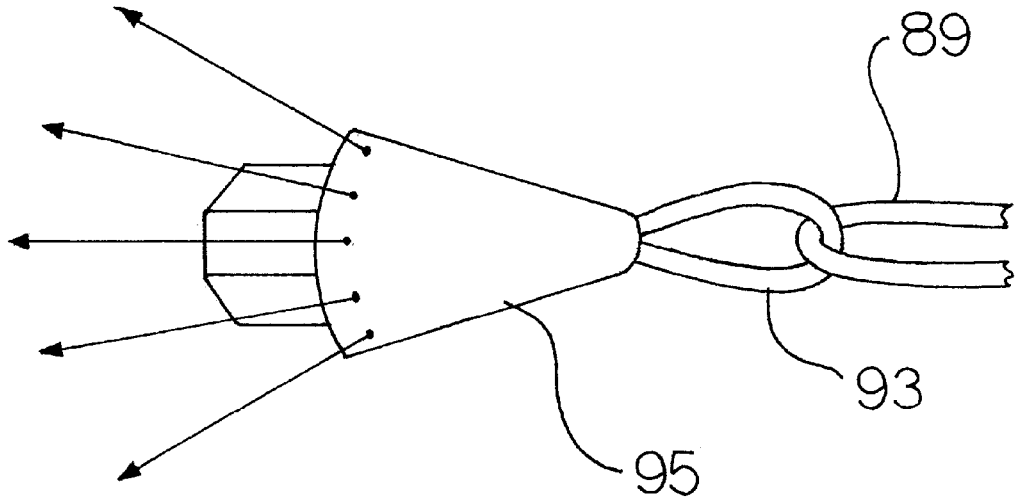
FIG. 14 is a view of still another nozzle adapted for use with the present invention.

An alternate down-leg invert adapter in the form of a T-shaped adapter 84 (FIG. 11) with a guiding curved portion formed in the adapter is generally interchangeable with the elbow adapter 34, and as shown in FIGS. 11 and 12, is preferred in instances where the elbow adapter would undesirably restrict flow in the sewer line. Specifically, the T-shaped adapter has a second opening to the sewer line, facing in the direction away from the obstruction, and providing for a relatively unrestricted flow passage at the location of the adapter. Depending on whether the T-shaped adapter is positioned upstream or downstream of the restriction with respect to the direction of normal flow in the sewer line, such an arrangement permits the flow of effluent from upstream of the adapter fitting, or permits the outflow of effluent away from the section of sewer line between the obstruction and the adapter fitting.

It is noted that the actual flow restriction caused by the presence of the elbow adapter 34 in the sewer line 12 is related to the ratio between the diameters of the elbow and the sewer line, and the restriction, or lack thereof can to a certain extent be established by selecting the size of the elbow adapter in relation to the diameter of the sewer line. The use of the T-shaped adapter simply obviates the need to consider the relative sizes in those instances where relatively unrestricted flow is desired.

In the embodiment shown in FIG. 1, the apparatus 10 includes an invert down-leg hold-down bracket 52 for providing safe access to the sewer line through a manhole. The hold-down bracket 52 includes a grate 54 with a surrounding and supporting frame structure, and a clamping apparatus 56 for securing and stabilizing the adapter fittings 16 in the manhole. Preferably, the grate and supporting structure are adapted to support the weight of the operator of the apparatus 10.

The clamping apparatus 56 includes a first half-tube section 58A welded or other wise secured to the grate 54 or supporting frame, and a second half-tube section 58B mounted for swinging about a pin or swivel 64 toward and away from the first tube section 58A. More specifically, the second tube section 58B is secured to a plate that is rotatably mounted to the pin 64. The pin 64 is securely connected to the grate or supporting frame such that the second tube section 58B swings relative to the grate.

A plate 60 includes a sleeve 62 mounted to the pin 64 for swinging outwardly of the second tube section 58B, and a hinged latch 76 adapted for manually releasable locking engagement with a post 76 connected to the first tube section 58A. Thus, the plate 60 and second tube section 58B are mounted for swinging toward and away from the first tube section 58A to selectively surround or release an upper portion of the adapter fittings.

The adapter fittings are secured between the tube sections 58A and 58B by simply turning or rotating the handle 74 that is pinned in a fork-shaped member 72. A threaded rod section 70 formed on the opposite end of the member 72 is threadably received into a nut 66 and sleeve 68, and the nut 68 is welded or otherwise connected to the plate 60. As the handle is turned, the free end of the threaded rod section 70 moves to engage the second tube section 58B and drive the second tube section toward the first tube section 58A, and clamping the adapter fittings 16 therein. As will be evident, turning the handle in the opposite direction released the adapter fittings from the clamping engagement of the tube sections 58A and 58B, and releasing the latch 76 from the post 78 and swinging the plate 60 and the second tube section 58B away from the first tube section 58A enables installation and removal of the adapter fittings in the manhole.

Additional nozzle configurations are suitable for use with the present invention, a few of which are shown in the drawings in FIGS. 9A, 9C–D, and 14. Nozzles 17 and 19 (FIGS. 9A, and 9C, respectively) are nozzles equipped with orifices adapted to provide generally rearwardly directed, generally conical-shaped spray. As a result of the rearwardly directed spray, such nozzles are adapted to thrust forwardly when supplied with steam or hot water. In this instance, the nozzle may be connected to either the push wand, or to the conventional hose 26, and the forward thrust from the discharging water or steam drives the nozzle and the hose through the sewer line toward the obstruction. Nozzle 95 (FIG. 14) is equipped with a pulling eye 93 connected to the downstream end thereof, and may be used in connection with a wench and a cable 91 entering the sewer line through a manhole located oppositely of the obstruction, with respect to the location of the adapter fittings, to mechanically pull the nozzle through the sewer pipe, and thus through the obstruction. It will be apparent that other nozzle configurations may also be utilized with the present invention.

Selection of operating temperatures and pressures, and nozzle selection will, to a certain extent, be a matter of personal preference of the operator, and, of course, will be dependent upon the nozzles available to the operator and the operating limits of the apparatus 10. However, preferred nozzle selection and adapter fitting set-up will depend to a great extent on the type of build-up or obstruction in the sewer line, and whether access is provided to the sewer line upstream or downstream of the obstruction. For example, light finger root obstructions or build-up along the inner walls of the sewer pipe are typically removed with nozzles that provide for substantially radial, high pressure streams of water directed outwardly from the nozzle toward and along the annular walls of the sewer pipe. In this instance, nozzles that provide either forwardly or rearwardly directed streams may be used. Thus, nozzles such as shown in FIGS. 9A–9C may generally be utilized for clearing such sewer lines, the selection of which may also depend on whether access is available upstream or downstream of the build-up.

If a pipe is completely blocked, a forwardly thrusting nozzle such 17 or 19 (FIGS. 9A and 9C, respectively) may be utilized to clear an initial opening in the obstruction. Nozzle 17 is capable of clearing an opening in a completely blocked line if the blockage is from relatively soft material such as grease of other soft or meltable waste materials. Nozzle 19 (FIG. 9C) is constructed similar to a conventional "jetter" nozzle, in that it is a forwardly thrusting nozzle with at least one forwardly directed stream. Thus, the forwardly directed stream from the nozzle 19 is particularly useful in creating an initial opening through a blockage caused by most materials. However, unlike conventional jetter nozzles, the materials and orifice sizes of nozzle 19 are specially adapted for use in connection with the high pressures and temperatures associated with the present invention. The enhanced cleaning efficiency of streams of high-pressure, high-temperature water enable the nozzle 19 to be constructed to use water at a substantially reduced rate when compared with conventional jetter nozzles.

Nozzles 18 and 20 (FIGS. 9B and 9D, respectively) provide forwardly directed jets of hot water or steam, and are especially useful in clearing obstructions that substantially close off a sewer or drain line. In keeping with the invention, connection of such forwardly discharging, rearwardly thrusting nozzles to a push wand 14 enables the use of such nozzles for cleaning the sewer line.

Nozzle 20 (FIG. 9D) is a commercially available high-pressure, high-temperature, so-called "turbo-tip" nozzle that provides for forwardly directed high pressure and temperature jets of water or steam, and that includes a forward tip section mounted for spinning as the water flows therethrough. The forwardly directed, spinning, high-pressure streams of water result in a "cutting action" that makes the nozzle particularly useful in cutting through both soft and relatively hard obstructions, including large tree roots, when immediate removal of the obstruction is desired. The ability of such turbo-tip nozzles to cut through an obstruction diminishes as the distance between the nozzle and the obstruction increases, and if the nozzle is submerged in water. Therefore, if access to the sewer line is provided upstream of the obstruction, use of a nozzle such as nozzle 18 to clear a small opening through the blockage, and allow the flow through the obstruction and on down the sewer, enables use of the nozzle 20 without concern that the area between the nozzle and the obstruction will become flooded.

Alternately, if access is provided to the sewer line 12 downstream of the obstruction 24 (see FIG. 12), nozzle 20 may be utilized to cut through the obstruction without the need to create an initial opening since the water from the nozzle will evacuate the area as a result of the natural flow in the sewer line, provided that the adapter fittings as previously discussed do not substantially block the flow in the vicinity of the downstream manhole.

With upstream access to a partially blocked sewer line 12, or with downstream access to a completely blocked line, the turbo-tip nozzle 20 provides for the quickest removal of a substantial build-up or complete obstruction in the sewer line, provided the diameter of the sewer line is within the effective operating or cutting diameter of the turbo-tip nozzle utilized.

Nozzle 18 (FIG. 9B) is a high-pressure, combination water/steam nozzle that provides substantially forwardly directed streams of hot water and steam, and is particularly useful in clearing blockages such as tree root structure when immediate removal is not necessary or possible. In this instance, the obstruction and a portion of the sewer line are heated to a relatively high temperature with high pressure steam such that the tree roots are in essence "cooked" in a high-temperature environment. The roots will then die and fall-off in a softened and substantially disintegrated form, and flow out the sewer line in approximately five to seven days. In some instances, a re-treatment with the nozzle 18 may be necessary to finish clearing an obstruction, and it may be desirable to use a combination of the nozzles 18 and 20 for clearing obstructions.

The decision as to whether to use either the nozzle 18 or the nozzle 20, or both, will depend in part of the sizes of nozzles available to the operator, and the size of the sewer line. The cutting diameter of a turbo-tip nozzle 20 is related to the diameter of the nozzle and the angle of the jets of water. Currently available turbo-tip nozzles are effective in cutting through obstructions in twelve inch diameter lines or smaller. Thus, if the obstruction is in line larger than twelve inches, or larger than the line size for which the operator has a turbo-tip nozzle, the operator will preferably remove as much of the obstruction as possible with the turbo-tip, and remove the remainder of the obstruction with the nozzle 18 as previously described.

The generally cylindrical, inflatable plug 80, commonly known as a cherne plug, may utilized to aid in clearing obstructions from the sewer line in certain instances. Cherne plugs are commonly formed with a longitudinally extending, centrally located opening, are inflated with the aid of an air compressor (not shown) and a hose 82 connected between the compressor and hose, and are constructed so that the inside diameter of the central opening can be reduced to a desired size or to completely close as the plug is inflated. Alternate cherne plugs are available without the center opening so that the plug will be solid when inflated.

Figure 10:
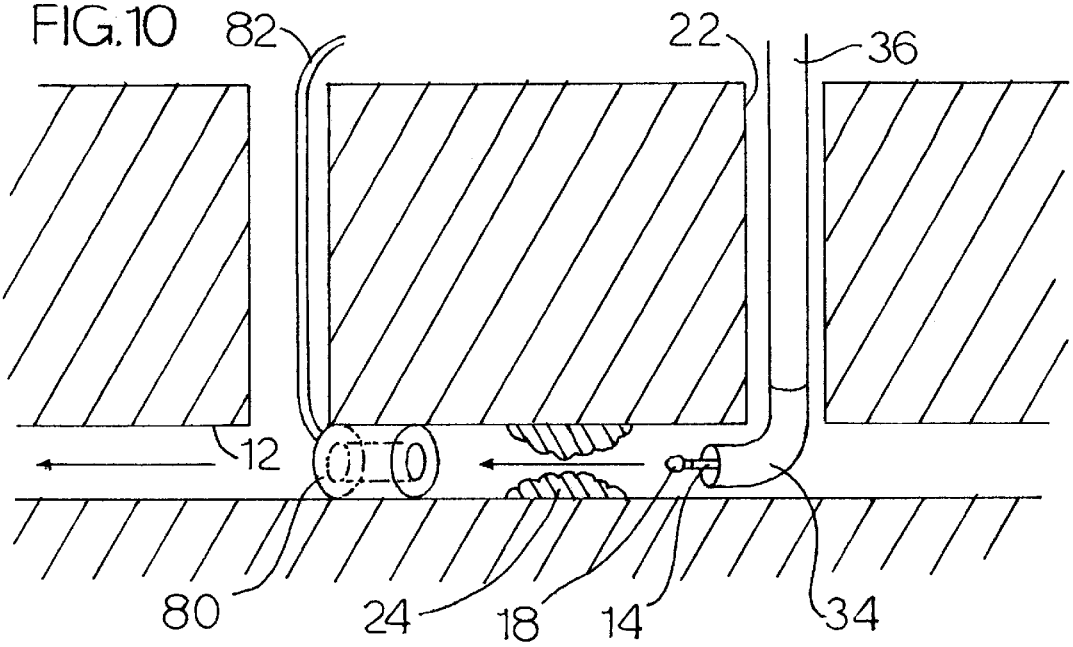
FIG. 10 is a view of an alternate arrangement and method thereof utilizing an inflatable cherne plug and nozzle of FIG. 9B according to the present invention.

Two common uses of the cherne plug 80 are illustrated in FIGS. 7 and 10. In FIG. 7, the downstream end of the elbow adapter 34 is positioned in the central opening of the cherne plug, the plug is positioned in the sewer line downstream of the manhole opening, and the plug is then inflated such that the inside diameter of the central opening closes inwardly around the downstream end of the elbow, and the outer diameter of the plug expands against the inside wall of the sewer line. As a result, the plug and elbow cooperate to block the entire diameter of the sewer line, preventing effluent in the sewer line upstream of the plug from flowing into and entering the area where the working nozzle is located between the plug and the obstruction, while providing access by the nozzle to the obstruction. Such an arrangement is useful, for example, if the upstream flow may be substantial, and a turbo-tip nozzle 20 is being used to cut through the obstruction.

If using the T-shaped adapter 84, blocking flow in the sewer line from upstream can be provided for by simply positioning a plug 80 in the sewer line upstream of the manhole, and inflating the plug to engage the sewer wall and close the centrally located opening in the plug.

In FIG. 10, the plug 80 is positioned downstream of the obstruction 24 and is inflated to size the central opening to substantially restrict the flow. Such an arrangement is useful, for example, in creating a substantially closed chamber in the sewer for building and maintaining a high temperature environment surrounding the obstruction such as previously described in utilizing nozzle 18 to cook roots and other live organic-based obstructions.

It will be apparent that the plug 80 may be used in other arrangements and circumstances within the scope of the present invention. For example, plugs may be positioned both upstream of the nozzle and downstream of the obstruction for blocking flow from upstream in the sewer line and creating a flow restriction downstream of the obstruction.

FIGS. 11 and 12 illustrate two alternate adapter fitting arrangements permanently installed in buildings. In FIG. 10, the T-shaped adapter 84 is installed into a drain line below a floor, an end adapter 38 extends upwardly therefrom, and a plate or condensation boot 91 is secured to the floor to cover the opening therein surrounding the end adapter and to secure the adapter fittings in place. A push wand 14 and nozzle 18 are installed and connected to a conventional quick-connect or threaded coupling 94 that is secured in a cap 92 which is in turn threaded into or otherwise secured to the end adapter 38. The coupling 94 preferably includes an integral check valve such as is commonly available with conventional quick-connect couplings, or an externally located check valve (not shown) may be added to the system, or the coupling may be simply capped when not in use to prevent sewer gasses from escaping into the building. An end cap 88 closes the upper opening of the end adapter 38. With this arrangement, the line downstream of the adapter fittings can be cleaned by simply connecting a leader hose 26 to the coupling 94, and turning on a hot water or steam supply at the upstream end of the hose. In this instance, the T-shaped adapter is preferably sized at or approximately equal to the diameter of the drain line to provide for unrestricted flow through the line.

The installation shown in FIG. 12 is similar to the installation shown in FIG. 11, except that a vent adapter fitting 90 is connected to the roof of the building to provide normal venting of the sewer line, and an exhaust for steam from use of the apparatus during cleaning of the line. In other words, the cleaning apparatus according the present invention is installed into the sewer venting system of the building.

Alternately, the adapter fitting arrangements shown in FIGS. 11 and 12 may be installed without the push wand and nozzle, and a removable sealing cap (not shown) installed in place of the cap 92 with the coupling 94, the removable cap normally sealing off the respective leg of the end fitting 38 and providing access to the drain line for cleaning.

It will be apparent with a review of FIGS. 11 and 12 that adapter fittings 16 may not be necessary in instances where the drain line is in relative close proximity to the floor or the ground, and where the size of the access opening and the drain line enable relative ease of manually insertion of the nozzle into the leg of the drain line with the build-up or obstruction, particularly if utilizing forwardly thrusting nozzles. If utilizing a rearwardly thrusting nozzle, adapter fittings may not be necessary if the push wand is sufficiently stiff to enable operation of the rearwardly thrusting nozzle in the leg with the obstruction without causing the push wand to collapse rearwardly into the opposite leg of the drain line, or if the access opening and the push wand cooperate to provide sufficient support against the rearwardly thrusting nozzle.

The process of the present invention involves the utilization of the inventive apparatus 10 and various embodiments and combinations of components previously described. In general, the adapter fittings 16, including adapter 34 or 84 and extension 36, are first positioned over and inserted into an opening 22 to a sewer pipe 12. A selected nozzle (e.g., one of 17, 18, 19, or 20) and a hose 26 or push wand 14 are then inserted through the adapter fittings and into the sewer line. The nozzle is directed through the sewer pipe until it reaches the build-up or obstruction 24 whereupon high-pressure, high-temperature water or steam are delivered from the power jet steam supply 21 through the nozzle and directed at the obstruction for removal from the sewer line. The discharge of steam or water will create an effluent in the sewer pipe generally between the adapter fitting and the obstruction, and it is generally important that this effluent be removed while operating the apparatus, to allow the cleaning action of the jets flowing from the nozzle to continue clearing of the obstruction or build-up. To this end, the apparatus is typically installed in a manner to insure effluent is allowed to flow downstream from the obstruction, either through the obstruction or through or around the adapter fittings 34 or 84 positioned downstream of the obstruction.

The apparatus and methods of the present invention are suitable for use in various forms of sewers and drain lines. As is evident from the above description, there are many possible combinations of components, and methods associated therewith within the scope of the invention. However, the following descriptions will illustrate a few methods of practicing the invention, and those not specifically mentioned will be apparent to one skilled in the art from an understanding of the invention as described and claimed herein.

By way of example, the use of the apparatus may be utilized in municipal main sewers through general adherence to the following steps:

1. The manhole covers for the municipal main sewers are removed either up and/or down stream from the obstruction 24.
2. The inside diameter of the sewer pipe 12 is determined. If the diameter is larger than 6" ID, an inflatable cherne plug 80, with an invert down-leg adapter fitting 34 or 84, are connected for insertion into the manhole.
3. The depth of the invert of the manhole is determined in order to select the number or length of extension 36 needed to reach between the down leg adapter fitting 34 connected to the cherne plug 80 when located in the sewer line (see FIG. 7).
4. The appropriate length of extension is added to the down-leg adapter in order to extend the opening of the down leg above the grade or opening of the manhole cover. FIG. 1 generally shows the connection of the adapters in place in the invert of the sewer, with an extension attached to the adapter, and a bracket 52 suitable for maintaining the stability of the down leg extensions when inserted in the manhole.
5. A selected nozzle or power jet steam tip (e.g., 17, 18, 19 or 20) is attached to a leader hose 26 connected to the power jet steam supply 21.
6. A push wand adapter is connected to the power jet steam tip. The push wand or rigid cable is then attached to the adapter. Alternately, a combined push wand 14 is attached to the nozzle. The leader hose or push wand is then inserted into the invert down leg by pushing on the push wand cable until the power jet steam tip has moved past the down leg adapter and into the sewer as illustrated in FIG. 1.
7. An external water supply or a reservoir hose bib (not shown), of about 30 psi or greater, is attached to the power jet steam supply 21 in order to charge the system.
8. The power jet steam supply is started and adjusted to the appropriate temperature and pressure control settings. Steam is typically not utilized at this point of the process.
9. The push wand 14 is manually fed into the sewer to advance a power steam jet nozzle 18 or 20 toward the obstruction. Alternately, water may be delivered through a forwardly thrusting nozzle 17 or 19 in order to pull the hose and nozzle toward the obstruction 24.
10. The nozzle continues to advance, feeding additional length of push wand or hose into the adapter fittings until the obstruction is encountered.
11. The temperature and pressure is adjusted to appropriate levels to dislodge or remove the obstruction.
12. The leader hose is continuously forced into the sewer using the push wand. The temperature inside and outside the leader hose is raised to exceed 300F. If the push wand does not feed easily through the obstruction, steam may be provided to penetrate the obstruction over time until the obstruction is soft enough to be removed by the streams of pressurized hot water.
13. Once the obstruction has been cleared, allow the push wand or leader hose to continue past the known obstruction point. The temperature and pressure controls may then by reset to the levels utilized during insertion of the leader hose and tip into the sewer.
14. The push wand cable and leader hose are retrieved with the temperature and pressure controls at the insert settings to completely back flush the length of sewer pipe.
15. The water pressure is turned of when the nozzle reaches the invert down leg adapter fitting.
16. If the obstruction has not been completely cleared, a different style nozzle may be placed upon the hose and the insertion and cleaning steps repeated.

The following procedures generally apply to smaller sewers or private laterals of less than 6" in diameter:

1. The clean out cover, generally located just inside or just outside of the foundation of the building, is first removed.
2. The size of pipe is determined.
3. If no standing water is present in the sewer and the clean out is outside of foundation and downstream of the obstruction:
   a. Attach the hose 26 or push wand 14 to the appropriate power jet steam tip.
   b. Insert the tip into the sewer line until the obstruction is encountered, and mark the footage of hose that has been inserted to aid when retrieving the power jet steam tip.
   c. Start the water and steam supply system 21 and purge the sewer such as in the same general manner as previously described.
4. If the clean out is on the inside of the foundation:
   a. A cover or rubber exhaust boot adapter with an opening for the nozzle and hose should be utilized prevent ingress of sewer gasses and steam or water condensate into the building through the access opening.
   b. The appropriate power steam jet tip and the leader hose or push wand are inserted through the exhaust boot and a clean out procedure generally described above is utilized.

The apparatus and process of the present invention may also be utilized in, for example, restaurants as a grease block preventer to aid in maintaining the integrity of drain systems, and the following procedure is generally applicable:

1. First, the sewer clean out is located and the clean out cap is removed. An adapter fitting 84 and a clean out extension adapter 38 is installed with the new cap 88 as generally illustrated in FIG. 11 and as previously described.
2. The push wand and nozzle are inserted into the clean out fitting adapters.
3. The power steam jet supply 21 is connected to the hose or connector 94, and the line is purged according to volume recommendations or drainage capacity of the pipe size and by the volume of effluent.

This type of system can also be adapted for permanent installation as shown in FIG. 11 and directly to a sewer venting system through the utilization of a vent adapter as illustrated in FIG. 12.

From the foregoing, it will be apparent that the present invention brings to the art new and improved apparatus and methods for removing obstructions from sewer and drain lines. By virtue of novel use of adapter fittings, a cleaning nozzle and hose are quickly and easily inserted into and orientated in the leg of the sewer with the obstruction. Nozzles adapted for high-temperature, high-pressure water or steam enable obstruction removal processes previously unavailable. And a unique stiffened push wand in combination with the adapter fittings or other supporting structure enables the use of forwardly spraying of the high-pressure, high-temperature water to quickly cut through the obstruction. These and other apparatus and methods disclosed herein facilitate relatively quick and reliable removal of obstructions from sewer and drain lines.

I claim:

1. A method for cleaning or clearing obstructions or build-up from a drain line having an access opening, said method comprising the steps of:

(A) providing:

(1) hot water or steam supply means, (2) hose means having an upstream end connected to said supply means and having a downstream end, and (3) a nozzle having an inlet connected to the downstream end of said hose means and having a plurality of discharge orifices, and (4) stiffened pushwand means connected to one of said nozzle and the downstream end portion of said hose means;

(B) inserting the nozzle through said access opening and into the portion of the line to be cleaned;

(C) delivering a supply of hot water or steam to the nozzle, said discharge orifices directing streams of hot water or steam toward the obstruction or build-up for cleaning said line; and (D) advancing the nozzle forwardly through the drain line.

2. A method as defined in claim 1 in which said streams are directed with a rearward component for effecting simultaneous occurrence of said advancing and said delivering steps, said streams further being directed with a radial outward component for impinging on and cleaning the line rearwardly of the advancing nozzle.

3. A method as defined in claim 1 in which said streams are directed with a forward component for impinging on and eroding through an obstruction in the drain line forwardly of the nozzle, said hose means being sufficiently stiff to maintain the nozzle in position in the line against the rearwardly directed forces resulting from said streams.

4. A method as defined in claim 3 further comprising the steps of:

(E) providing plug means adapted to substantially block the line;

(F) positioning said plug means in said line to create a substantially closed environment in the line surrounding the obstruction;

(G) raising the temperature inside said environment by spraying steam into said environment; and (H) maintaining such temperature for a period of time to soften the obstruction for subsequent removal.

5. A method as defined in claim 3 in which said nozzle includes a forward end portion having said orifices, said forward end portion being connected for rotation simultaneously with said delivering step for rotation of said streams.

6. A method as defined in claim 1 further comprising the steps of:

(E) providing adapter fitting means sized for positioning into said access opening and to extend into said line, said adapter fitting means having first channel means with inlet and outlet openings and extending therethrough, said channel means being sized to slidably receive said nozzle and the hose connected thereto;

(F) positioning said adapter fitting means into said access opening;

(G) orienting said adapter fitting means such that said outlet opening faces the portion of said line to be cleaned; and (H) effecting said inserting step by inserting the nozzle through said channel means, said channel means guiding the nozzle from said inlet opening into the portion of the line to be cleaned.

7. A method as defined in claim 6 in which said adapter fitting means includes second channel means connected to said first channel means, said second channel means having an outlet opening facing in a direction away from the portion of the line to be cleaned to permit the out-flow of water from between said adapter fitting means and the obstruction.

8. A method for cleaning or clearing obstructions or build-up from a drain line having an access opening, said method comprising the steps of:

(A) providing:

(1) hot water or steam supply means, (2) hose means having an upstream end connected to said supply means and having a downstream end, (3) a nozzle having an inlet connected to the downstream end of said hose means and having a plurality of discharge orifices, and (4) adapter fitting means having:

(a) first channel means with inlet and outlet openings and extending therethrough, and (b) second channel means connected to said first channel means and having an outlet opening facing in a direction away from the outlet opening of said first channel means for permitting water flow therebetween;

(B) positioning said adapter fitting means through said access opening;

(C) orienting said adapter fitting means such that the outlet opening of said first channel means faces the portion of said line to be cleaned and the outlet opening of said second channel means faces away from the portion of the line to be cleaned to permit out-flow of water from between the obstruction and said adapter fitting means;

(D) inserting the nozzle through said first channel means and into the portion of the line to be cleaned;

(E) delivering a supply of hot water or steam to the nozzle, said discharge orifices directing streams of hot water or steam toward the obstruction or build-up for cleaning said line; and (F) advancing the nozzle forwardly through the drain line.

9. A method for cleaning or clearing obstructions or build-up from a drain line having an access opening, said method comprising the steps of:

(A) providing:

(1) hot water or steam supply means, (2) hose means having an upstream end connected to said supply means and having a downstream end, (3) a nozzle having an inlet connected to the downstream end of said hose means and having a plurality of discharge orifices, and (4) adapter fitting means sized for positioning into said access opening and to extend into said line, said adapter fitting means having channel means with inlet and outlet openings and extending therethrough;

(5) cover means sized to cover said access opening, said cover means having an opening for receiving said adapter fitting means therethrough, and (6) clamp means operative to secure said adapter fitting means in the opening in said cover means;

(B) positioning said cover means over said access opening;

(C) positioning said adapter fitting means into the opening in said cover means;

(D) orienting said adapter fitting means such that the outlet opening of said channel means faces the portion of said line to be cleaned;

(E) securing said adapter fitting means in the opening in said cover means;

(F) inserting the nozzle through said first channel means and into the portion of the line to be cleaned;

(G) delivering a supply of hot water or steam to the nozzle, said discharge orifices directing streams of hot water or steam toward the obstruction or build-up for cleaning said line; and (H) advancing the nozzle forwardly through the drain line.

10. A method for clearing an obstruction located in a drain line portion having first and second opposing end portions and having an access opening joining one of said end portions, said method comprising the steps of:

(A) providing:

(1) steam supply means, (2) hose means having an upstream end connected to said supply means and having a downstream end, and (3) a nozzle having an inlet connected to the downstream end of said hose means and having a plurality of discharge orifices for spraying steam therefrom;

(B) inserting the nozzle through said access opening and through said one end portion into said drain line portion;

(C) substantially blocking said one end portion to create a substantially closed environment in said line portion between said one end portion and said obstruction;

(D) spraying steam into said substantially closed environment to raise the temperature therein; and (E) maintaining such temperature for a period of time to soften the obstruction for removal from said drain line portion.

11. A method as defined in claim 10 further comprising the steps of:

(F) providing first plug means adapted to substantially block said line portion; and (G) inserting said plug means into said one end portion to accomplish said blocking step.

12. A method as defined in claim 11 further comprising the steps of:

(H) providing adapter fitting means adapted to guide said nozzle through said access opening and said one end portion and into said drain line portion, said adapter fitting means being further adapted to cooperate with said plug means for creating said substantially closed environment;

(I) inserting said nozzle through said adapter fitting means; and (J) positioning said adapter fitting into said one end portion to assist in creating said substantially closed environment.

13. A method as defined in claim 11 further comprising the steps of:

(H) providing second plug means;

(i) inserting said second plug means into said second end portion to assist in creating a substantially closed environment surrounding said obstruction.

14. A method as defined in claim 11 further comprising the step of:

(H) providing stiffened pushwand means connected to one of said nozzle and the downstream end portion of said hose means to assist in supporting the nozzle from rearward movement resulting from steam spraying therefrom.

15. A method for clearing an obstruction located in a sewer drain line portion having first and second opposing end portions and having an access opening joining one of said end portions, said method comprising the steps of:

(A) providing:

(1) steam supply means, (2) hose means having an upstream end connected to said supply means and having a stiffened downstream end portion, and (3) a nozzle having an inlet connected to the downstream end of said hose means and having a plurality of forwardly opening discharge orifices for spraying steam forwardly therefrom;

(B) inserting the nozzle through said access opening and through said one end portion into said drain line portion;

(C) advancing the nozzle forwardly toward the obstruction;

(D) spraying steam forwardly onto said obstruction; and (E) maintaining said forwardly directed impingement of said steam onto said obstruction for a period of time to soften and then remove the obstruction.

16. A method as defined in claim 15 further comprising the steps of:

(F) providing first plug means adapted to substantially block said line portion; and (G) inserting said plug means into said one end portion to substantially block said one end portion and create a substantially closed environment between said one end portion and the obstruction.

17. A method as defined in claim 16 further comprising the steps of:

(H) providing adapter fitting means adapted to guide said nozzle through said access opening and said one end portion and into said drain line portion, said adapter fitting means being further adapted to cooperate with said plug means for creating said substantially closed environment;

(I) inserting said nozzle through said adapter fitting means; and (J) positioning said adapter fitting into said one end portion to assist in creating said substantially closed environment.

18. A method as defined in claim 16 further comprising the step of (H) providing stiffened pushwand means connected to one of said nozzle and the downstream end portion of said hose means to assist in supporting the nozzle from rearward movement resulting from steam spraying therefrom.

* * * * *

UNITED STATES PATENT AND TRADEMARK OFFICE

CERTIFICATE OF CORRECTION

PATENT NO. : 5,988,188

DATED : November 23, 1999

INVENTOR(S) : Joseph C. Born

It is certified that error appears in the above-identified patent and that said Letters Patent is hereby corrected as shown below:

Column 2, line 64, change "and" to --as--.

Column 7, line 24, change "91" to --89--.

Signed and Sealed this

Thirtieth Day of May, 2000

*Attest:*

Q. TODD DICKINSON

*Attesting Officer*

*Director of Patents and Trademarks*